United States Patent [19]

Moreau

[11] Patent Number: 4,776,287

[45] Date of Patent: Oct. 11, 1988

[54] HEARTH GRATE WITH TRANSVERSE BARS OF ELEMENTS WHICH ARE SECURED TOGETHER BY THEIR FRONTAL FACES

[75] Inventor: André Moreau, Paris, France

[73] Assignee: T.I.R.U.-Traitement Industriel des Residus Urbains, Paris, France

[21] Appl. No.: 141,148

[22] Filed: Jan. 6, 1988

[30] Foreign Application Priority Data

Jan. 9, 1987 [FR] France ..... 8700140

[51] Int. Cl.[4] ..... F23H 17/00

[52] U.S. Cl. ..... 110/328; 110/281; 126/152 B; 126/175; 198/774

[58] Field of Search ..... 126/152 B, 174, 175; 110/268, 278, 286, 290, 291, 281, 282, 328; 198/773, 774

[56] References Cited

U.S. PATENT DOCUMENTS 2,250,067 7/1941 Martin ..... 110/38
4,239,029 12/1980 Martin et al. ..... 110/281 X
4,240,402 12/1980 Martin et al. ..... 110/268 X
4,450,952 5/1984 Steiner ..... 198/773
4,548,139 10/1985 Weber ..... 110/281 X
4,671,190 6/1987 Moreau ..... 110/281

FOREIGN PATENT DOCUMENTS 2599125 5/1986 France .

*Primary Examiner*—Edward G. Favors
*Attorney, Agent, or Firm*—Charles E. Brown; Charles A. Brown

[57] ABSTRACT

A hearth grate comprises a succession of transverse bars which are alternately fixed and movable with a reciprocating movement, said bars being formed by disposing in side-by-side relationship at vertical lateral faces elements which are generally rectangular, with a projection portion at the junction of a frontal face and a dorsal face and in the dorsal face blowing orifices opening in said projection portion.

The elements are held by the insertion into openings provided in the frontal faces of limbs of a fastener. The fastener comprises a transverse portion which is disposed in set-back relationship with respect to the frontal faces. Plate portions are welded over the openings to retain the fastener.

10 Claims, 3 Drawing Sheets

HEARTH GRATE WITH TRANSVERSE BARS OF ELEMENTS WHICH ARE SECURED TOGETHER BY THEIR FRONTAL FACES

BACKGROUND OF THE INVENTION

1. Field of the Invention

The invention relates to a hearth grate for supporting a mass of solids undergoing combustion, in particular city refuse, comprising, in a downward slope from an upstream charging zone to a downstream ash pit, a succession of transverse bars which are alternately fixed and movable with a longitudinal reciprocating movement, and comprising on the top a dorsal face for supporting the mass and a frontal face supported slidably on the dorsal face of an upstream bar, each bar being formed by a plurality of generally rectangular elements which are combined together at vertical lateral faces.

2. Description of the Prior Art

Grates in which the faces of the elements which are provided for the pushing operation are directed in the upstream direction in order to resist the rapid downward movement of the combustible solid materials and to cause stirring and mixing of the mass have been known in the art since U.S. Pat. No. 2,250,067 lodged in 1939. Since then, improvements have been made, relating in particular to the arrangement of blowing orifices which pass through the elements to supply combustion air to the mass which is undergoing combustion, from blowing boxes which are disposed below the grate.

U.S. Pat. No. 4,671,190 describes a hearth grate of return motion type, which comprises bar elements provided at the junction between the frontal face and the dorsal face and on the dorsal face with a transverse faceted projection portion, with air blowing orifices which are provided in a rearward facet of the projection portion so as to face downstream, and to channel jets of air from the underneath of the grate into the mass of combustible solid materials, in a direction which goes upwardly at an angle of about 15° to the horizontal.

That patent specification also describes means for holding the interconnected bar elements in a condition of alignment, such means comprising transverse pins which pass through holes provided in the lateral faces at the location of the projection portions.

To obtain stability of combustion settings in particular it is essential for the blowing air to reach the material undergoing combustion only by way of the blowing orifices. It is therefore necessary to ensure that the bar elements are not lifted by the solid materials which are undergoing combustion at the position where they are supported by the lower edge of their frontal face on the dorsal face of the immediately upstream-disposed element. It will be recalled that the bars are kept in position by their weight and held by the rearward end of their underneath face on a transverse member which is engaged into a transverse groove provided in that underneath face. The transverse member is alternately fixed to the general grate framework structure and fixed to a frame arrangement which is movable with a reciprocating motion.

The aim of the division of the bars into transversely aligned elements is on the one hand to impart relative flexibility to the bar and on the other hand to facilitate assembly and dismantling of the grate by making elements of handlable sizes and weights.

However, the counterpart of such division is that the dangers of the elements being lifted by the material undergoing combustion are increased thereby; it is therefore recommended that the bar elements should be coupled together so that the total weight of the bar resists the lifting force.

The solution put forward by U.S. Pat. No. 4,671,190 does however suffer from disadvantages. The pins can be introduced into the holes provided for that purpose in the lateral faces of the elements, only when the bar is moved away from its positioning on the grate as the grate is delimited laterally by hearth walls. The bar must be set in position in the assembled condition, which involves handling operations in respect of the entire bar. Dismantling of the bar into its elements also requires the bar to be removed in its entirety from the grate and moved away in order to uncouple the elements. That is particularly troublesome when it is necessary to dismantle only a few elements, for example in order to replace them if they appear to be defective, as it is then necessary to manipulate all the entire bars which comprise at least one defective element.

SUMMARY OF THE INVENTION

To mitigate the disadvantages of the prior art, the invention proposes a hearth grate for supporting a mass of solids in a condition of combustion, in particular city refuse, comprising, in a downward slope from an upstream charging zone to a downstream ash pit, a succession of transverse bars which are alternately fixed and movable with a longitudinal reciprocating movement and have on the top side a dorsal face for supporting the mass and a frontal face supported slidably by a lower edge on the dorsal face of an upstream bar, each bar being formed by a plurality of generally rectangular elements in side-by-side relationship at lateral faces and coupling means disposed in the vicinity of the frontal faces to maintain the plurality of elements in a condition of transverse alignment, the coupling means comprising C-shaped fasteners each having two parallel limbs joined by a perpendicular transverse portion, each fastener being capable of being disposed in bridging relationship between two side-by-side elements, with each of its limbs engaged in a respective opening provided in the frontal face of a respective one of the side-by-side elements.

It will be appreciated that when using coupling means according to the invention, upon assembly of the grate, it is only necessary to manipulate separate elements, with the operation of setting the fasteners in position being carried out last. In addition, subsequently, to move or replace an element, it is only necessary to remove the two fasteners which attach it to the elements at respective sides thereof, or a single fastener if the element in question is an edge element.

Preferably the openings are symmetrical with respect to a central plane parallel to the lateral faces so that the adjacent openings of two side-by-side elements are disposed symmetrically with respect to the plane of the side-by-side lateral faces.

In accordance with preferred arrangements, the elements comprise grooves which connect the fastener limb openings to the adjacent lateral face to leave space for the transverse portion of the fastener. The transverse portion may be engaged into the grooves in setback relationship relative to the frontal face. The grooves may be prolonged by slots, along the limbs. It is possible to weld plate portions over the openings to prevent the fastener from coming out of the opening but those plate portions must not form a bridge between the elements, in order to retain the possibility of play.

Preferably the elements comprise transverse projection portions on their dorsal face, at the junction with the frontal face, with a rearward facet where blowing openings open out.

Features and advantages of the invention will be apparent from the following description given by way of example with reference to the accompanying drawings.

DESCRIPTION OF THE PREFERRED EMBODIMENT

Figure 1:
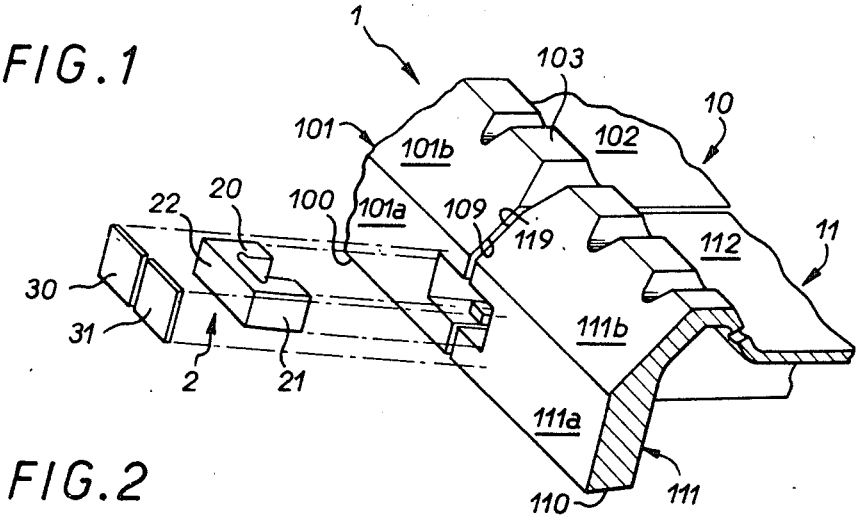
FIG. 1 is an exploded perspective view of coupling means comprising a fastener for adjacent bar elements of a hearth grate according to the invention.
Figure 2:
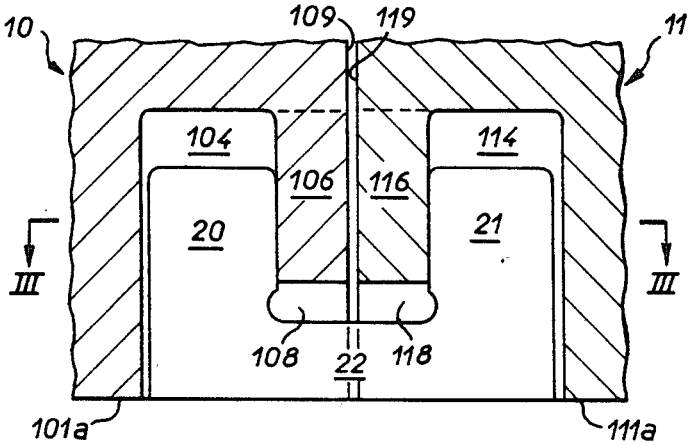
FIG. 2 is a view in section taken on line II—II in FIG. 3.

It will be assumed that the general hearth grate structure is known, in particular for a burner for city refuse and garbage, which will be very briefly described herein, with reference being made for the details for example to U.S. Pat. No. 4,671,190, that document constituting a state of the art which is close to the present invention.

It will be recalled that that kind of hearth grate comprises, in a downward slope from an upstream charging zone to a downstream ash pit, a succession of transverse bars which are alternately movable with a longitudinal reciprocating movement and are provided on the top side of the grate with a dorsal face for supporting the mass, and a frontal face supported slidably by way of a lower edge on the dorsal face of an upstream bar. Each bar comprises a plurality of generally rectangular elements disposed in side-by-side relationship at vertical lateral faces.

In the embodiment of hearth grate illustrated in FIGS. 1 through 6 of the accompanying drawings, two bar elements 10 and 11, of which only the regions which are of interest here are illustrated, are disposed in side-by-side relationship by way of lateral faces 109 and 119 respectively. The lateral faces are vertical on the grate when assembled and are perpendicular to respective front faces 101 and 111, as well as a dorsal faces 102, 112. The frontal faces 101 and 111 comprise lower and upper surface portions 101*a*, 101*b* respectively for the element 10 and 111*a*, 111*b* respectively for element 11.

The lower surface portion 101*a* is greatly inclined with respect to the plane of the dorsal face 102 (see FIG. 6) while the upper surface portion 101*b* is inclined at about 45° relative to the plane of the dorsal face 102.

In its lower part, each lower surface portion 101*a*, 111*a* terminates with an edge portion 100, 110 by way of which the respective element 10, 11 rests on the dorsal face of the element which is disposed immediately upstream.

At its junction to the upper surface portion 101*b* of the frontal face, the dorsal face 102 is surmounted by a projection portion 103 of trapezoidal cross-section, with a front facet 103*a* which is disposed in a position of continuity with the upper surface portion 101*b*, an upper facet 103*b* which is substantially parallel to the dorsal face 102, and a rear facet 103*c*. Provided in the rear facet 103*c* and perpendicularly thereto are blowing orifices 103*d*.

When the elements are in position on the grate, the orifices 103*d* are directed in the downstream direction, with their axes sloping upwardly at about 15° relative to the horizontal. The blowing orifices 103 are supplied with air by means of at least one box disposed below the grate.

As one bar in two is movable with a reciprocating movement, its projection portion 103 will alternately move towards and away from the projection portion of the upstream element and that of the downstream element so as to produce a stirring and mixing action in respect of the mass of solid material undergoing combustion. The relative angles of inclination of the frontal face 101 and the rear facet 103*c* are such that a block of combustible material which is caught between those surfaces is raised when they move towards each other.

The orientation of the blowing orifices 103*d* which is slightly inclined relative to the horizontal reduces the amount of fly ash entrained through the boiler tubes.

It is clear that regularity of combustion depends on regulation of the combustion air which is blown in, so that it is a matter of prime importance that an element cannot lift away from its support on the dorsal face of the upstream element.

In order to connect the elements of the same bar together, so that each of the elements is held in position by the total weight of the bar, coupling means are used.

Provided in each of the frontal faces 101 and 111 and more precisely in the lower surface portions 101*a* and 111*a* thereof, in the vicinity of the lateral faces 109 and 119 at which the elements are in side-by-side relationship, are openings 104 and 114 of rectangular section, which can receive limbs 20 and 21 of a C-shaped fastener 2, the two limbs 20 and 21 being connected by a transverse portion 22. The fastener 2 is of uniform thickness and its limbs 20 and 21 as well as its transverse portion 22 are of rectangular sections.

The openings 104 and 114 are extended towards the faces 109 and 119 by grooves 108 and 118 such that the transverse portion 22 of the fastener 2 can engage thereinto so as to take up a position in which it is set back with respect to the lower surface portion 101*a*, 111*a* of the respective frontal face 101, 111 while the limbs 20 and 21 respectively penetrate into the openings 104 and 114.

It should be appreciated that the openings 104 and 114 are disposed perpendicularly to the lower surface portions 101*a* and 111*a* of the frontal faces 101 and 111 and that the fastener 2 is oriented parallel to the lower edges 100 and 110.

A clearance is provided between the openings 104, 114, the grooves 108, 118 and the fastener 2 with its limbs 20 and 21 and its transverse portion 22, to permit clearances of the order of a millimetre in all directions, particularly since the components are of refractory cast iron which is fragile.

Figure 3:
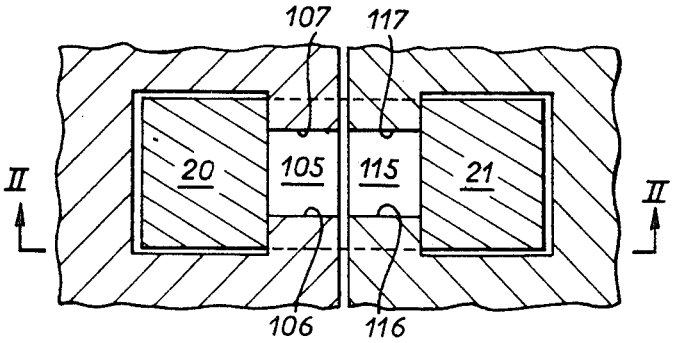
FIG. 3 is a view in section taken on line III—III in FIG. 2.
Figure 4:
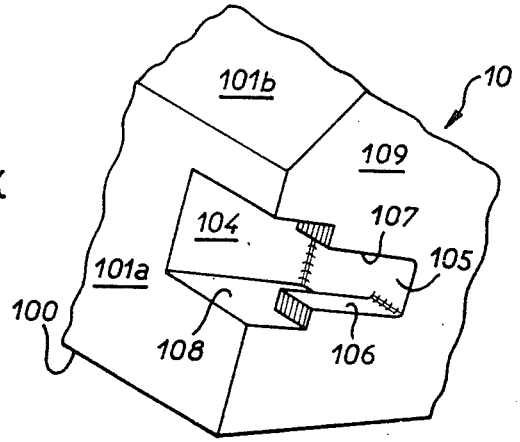
FIG. 4 is a perspective view of a bar element of a hearth grate according to the invention in the region at the angle between the frontal and lateral faces.
Figure 5:
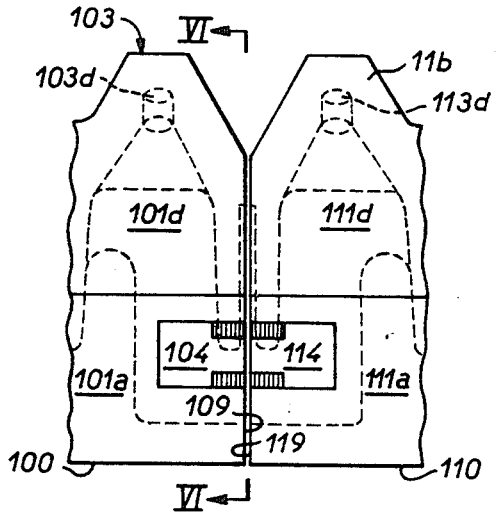
FIG. 5 is a front view of the region in which two bar elements are disposed in side-by-side relationship.
Figure 6:
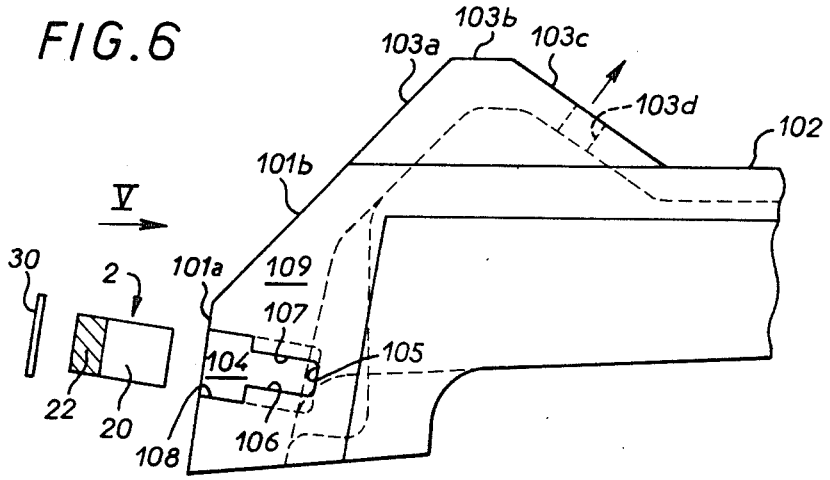
FIG. 6 is a lateral view from the front of a bar element taken on line VI—VI in FIG. 5.

Moreover, as will be seen in particular from FIGS. 3 and 6, the grooves 108 are prolonged by slots 105 which extend as far as the end of the opening 104, thus providing retaining projections 106 and 107 for the fastener limb (see FIG. 4).

That arrangement makes it possible to facilitate extraction of a fastener which is wedged in the openings, by breaking the transverse portion to introduce a hook behind the jammed limb.

It will be appreciated that the openings 104, 114 and the grooves 108, 118 are disposed symmetrically with respect to a plane in which the elements are disposed in side-by-side relationship, as embodied by the lateral faces 109 and 119. As the elements 10 and 11 are all of the same structure in each element in the vicinity of the lateral faces, there will be two openings 104 and grooves 108 which are disposed symmetrically with respect to a central plane of the element which is parallel to the lateral faces.

When the fastener 2 is in position, two rectangular plate portions 30 and 31 are welded over the mouths of the openings 104 and 114 so as to trap the fastener 2 in its openings. The operation of welding the plate portions 30 and 31 in position is effected by arc spot welds. By virtue of the fragility of the cast iron, a few blows with a chisel will cause the plate portions 30 and 31 to come away, to release the fastener 2 if this becomes desirable.

It may be advantageous to form pads or cushions of fibres at the bottom of the openings 104 and 114 so that the ends of the limbs 20 and 21 are in an arrested condition while retaining the possibility of play between the elements 10 and 11.

Figure 7:
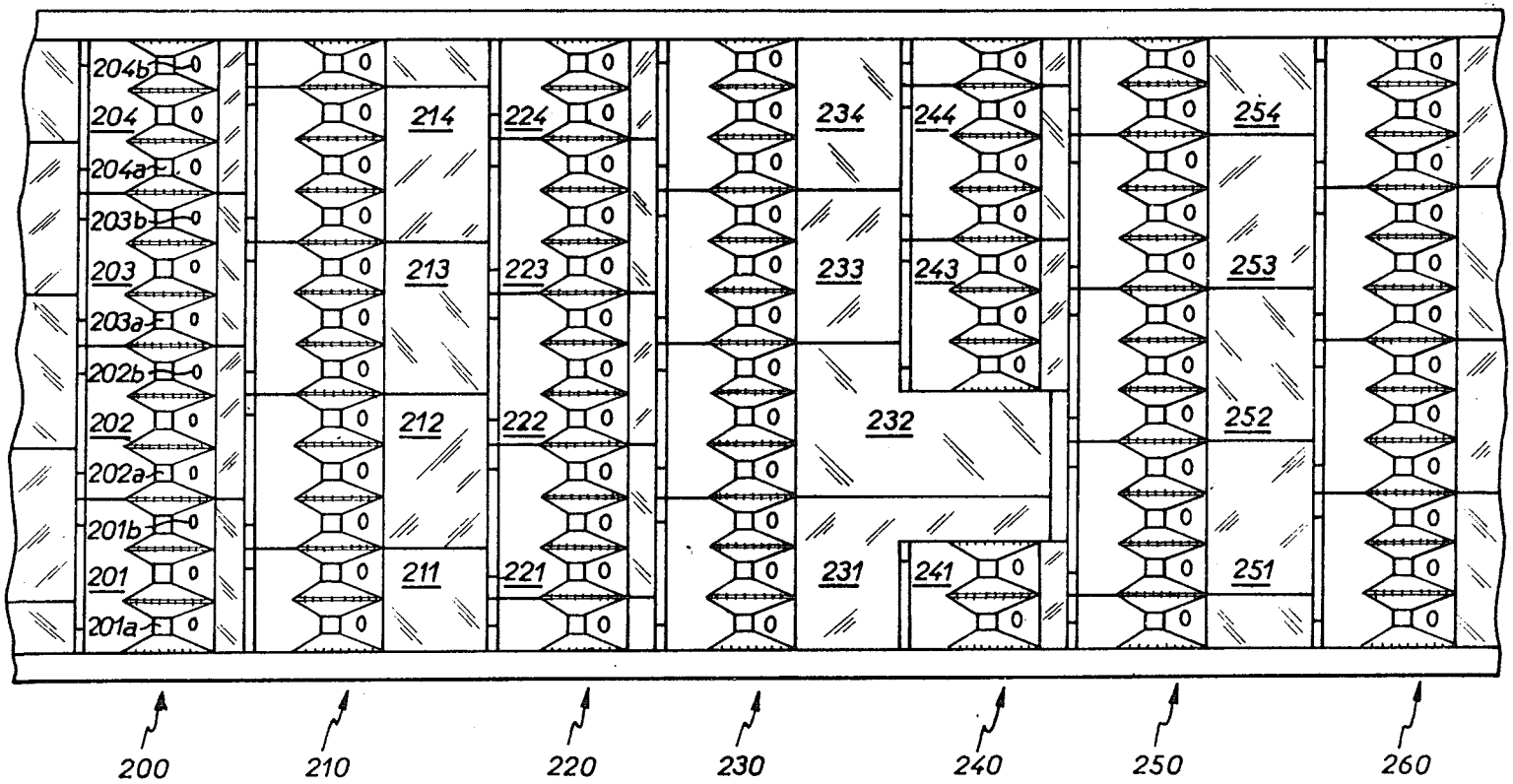
FIG. 7 is a view of a hearth grate according to the invention, from above.

FIG. 7 shows a longitudinal portion of a grate, comprising transverse bars 200, 210, 220, 230, 240, 250 and 260, each bar comprising a plurality of elements which are identified by the digits in respect of tens and hundreds of the bar to which they belong, the units digit being 1, 2, 3 or 4, in the direction from bottom to top.

The upstream part of the grate is at the left in FIG. 7 and the downstream part is at the right.

To avoid the formation of extended longitudinal joint lines, successive elements are offset laterally by a third of their width. One-third and two-third width elements are disposed at the ends of the bars 210, 220, 240 and 250, to provide that offset arrangement.

It will be noted that the element 242 is omitted so as to show the dorsal face of the upstream element 232 in its entirety.

It will also be observed that the bar elements comprise a projection portion on the dorsal face at the junction to the frontal face. The projection portions are identified by the reference of the element, followed by the letter a. Opening in the rear facet of the projection portions . . . a are blowing orifices which are identified by the reference of the element followed by the letter b. In order to make the Figure clearer, the references in respect of the projection portions . . . a appear only in relation to the bar 200, and only one blowing orifice is referenced per element in the bar 200.

It will be appreciated that the invention is not limited to the embodiments described but embraces all alternative constructions falling within the scope of the claims.

What is claimed is:

1. A hearth grate for supporting a mass of solids undergoing combustion, in particular city refuse, comprising, in a downward slope from an upstream charging zone to a downstream ash pit, a succession of transverse bars which are alternately fixed and movable with a longitudinal reciprocating movement, and have on the top a dorsal face for supporting the mass and a frontal face supported slidably by way of a lower edge thereof on the dorsal face of an upstream bar, each bar being formed by a plurality of generally rectangular elements which, at lateral faces thereof, are arranged in side-by-side relationship, and coupling means disposed in the vicinity of the frontal faces to maintain the plurality of elements in a condition of transverse alignment, the coupling means comprising C-shaped fasteners each having two parallel limbs joined by a perpendicular transverse portion, each fastener being capable of being disposed in bridging relationship between two side-by-side elements, with each of its limbs engaged in a respective opening provided in the frontal face of a respective one of the side-by-side elements.

2. A hearth grate as claimed in claim 1, wherein the two openings provided in the frontal face of each element for maintaining it aligned with similar elements disposed in side-by-side relationship at respective sides thereof are symmetrical with respect to a central plane parallel to the lateral faces of the element.

3. A hearth grate as claimed in claim 1, wherein the bar elements include grooves connecting each of the openings to the adjacent lateral face, said grooves being capable of receiving the transverse portion of one of the fasteners in bridging relationship between the two elements.

4. A hearth grate as claimed in claim 3, wherein the groove is sufficiently deep for the fastener transverse portion to be set back relative to the frontal face of the side-by-side elements.

5. A hearth grate as claimed in claim 3, wherein a slot extends the groove over the entire depth of the opening, the height of said slot being less than the thickness of the limbs of the fastener.

6. A hearth grate as claimed in claim 1, wherein the limbs and the fastener transverse portion are of rectangular section and of similar thicknesses.

7. A hearth grate as claimed in claim 4, wherein plate portions are welded in a flat position over the frontal faces, each at least partially covering one of the openings for receiving a fastener limb, without projecting over the frontal face of the adjacent element.

8. A hearth grate as claimed in claim 1, wherein each bar element has on its dorsal face at the junction with the frontal face at least one transverse projection portion with a rear, rearwardly facing facet where at least one blowing passage passing through the element opens.

9. A hearth grate as claimed in claim 8, wherein the blowing passages, in the grate, have an axis which is directed longitudinally downstream in a rising position, the slope of said axis being closer to a horizontal line than a vertical line.

10. A hearth grate as claimed in claim 9, wherein the slope of the axis of the blowing passage is approximately 15° and the rear facet of the projection portion is perpendicular to said axis.

* * * * *